US006042414A

United States Patent [19]

Kunert

[11] Patent Number: 6,042,414

[45] Date of Patent: Mar. 28, 2000

[54] VEHICLE DOCK FOR PORTABLE DATA COLLECTION TERMINAL

[75] Inventor: Steven R. Kunert, Cedar Rapids, Iowa

[73] Assignee: Intermec IP Corp., Woodland Hills, Calif.

[21] Appl. No.: 08/970,678

[22] Filed: Nov. 14, 1997

[51] Int. Cl.[7] ..... H01R 13/64

[52] U.S. Cl. ..... 439/374; 361/686; 248/310

[58] Field of Search ..... 248/27.1, 27.3, 248/680, 310, 681, 316, 316.2, 316.5, 316.1, 503, 500, 904, 906; 361/686, 380; 439/374, 357; 364/703; 224/929, 570; 245/346.03

[56] References Cited

U.S. PATENT DOCUMENTS

| | | | |
|---|---|---|---|
| 3,348,116 | 10/1967 | Freeman et al. | 320/115 |
| 4,141,616 | 2/1979 | Gottlieb | 339/75 M |
| 4,558,270 | 12/1985 | Llautaud et al. | 320/2 |
| 4,572,602 | 2/1986 | Rupnik | 339/65 |
| 4,629,962 | 12/1986 | Arakawa | 320/2 |
| 4,736,921 | 4/1988 | Zane et al. | 248/316.2 |
| 4,773,032 | 9/1988 | Uehara et al. | 364/709.04 |
| 4,806,906 | 2/1989 | Oda et al. | 340/311.1 |
| 5,030,129 | 7/1991 | Koch | 439/374 |
| 5,052,943 | 10/1991 | Davis | 439/357 |
| 5,123,064 | 6/1992 | Hacker et al. | 382/59 |
| 5,155,659 | 10/1992 | Kunert | 361/380 |
| 5,450,271 | 9/1995 | Fukushima et al. | 361/686 |
| 5,452,180 | 9/1995 | Register et al. | 361/686 |
| 5,466,170 | 11/1995 | Pavek | 439/374 |
| 5,687,060 | 11/1997 | Ruch et al. | 361/686 |
| 5,759,059 | 6/1998 | Chang et al. | 439/374 |
| 5,790,375 | 8/1998 | Lee | 361/686 |
| 5,805,416 | 9/1998 | Friend et al. | 361/686 |
| 5,816,725 | 10/1998 | Sherman et al. | 400/692 |
| 5,850,358 | 12/1998 | Danielson et al. | 364/707 |
| 5,875,094 | 2/1999 | Kirkendoll | 361/686 |
| 5,888,087 | 3/1999 | Hanson et al. | 439/374 |

*Primary Examiner*—Ramon O. Ramirez
*Assistant Examiner*—Tan Le
*Attorney, Agent, or Firm*—Suiter & Associates PC

[57] ABSTRACT

A docking apparatus for docking a portable data collection terminal in a vehicle comprises a housing which may be fixed to a surface in the interior of the vehicle, terminal cup mounted in the housing, and a pivoting front panel and a lever arm assembly. The lever, urged by a cam, causes the front panel to pivot and secures the data terminal in the docking apparatus for battery charging or data communication.

28 Claims, 10 Drawing Sheets

VEHICLE DOCK FOR PORTABLE DATA COLLECTION TERMINAL

RELATED APPLICATION

This application claims priority under 35 U.S.C. § 119(e) based on U.S. provisional application Ser. No. 60/031,235, filed on Nov. 14, 1996.

TECHNICAL FIELD

The present invention relates generally to a docking apparatus for a portable data collection terminal, and more specifically, to a recharging and/or data communication apparatus for docking a battery powered hand-held data collection terminal in a vehicle such as a delivery truck or van, forklift, and the like.

BACKGROUND OF THE INVENTION

Portable data collection terminals have many applications in a variety of industries. For example, a portable data collection terminal may be employed by a driver on a delivery route to record sales or to track inventory delivered to customers, or otherwise provide an automated accounting function. Another example is in the use of radio frequency data capture terminals on forklifts in warehouses or factories where items to be transported are identified by bar codes. Typically, a data collection terminal is placed in a storage apparatus or dock to recharge its internal batteries and transfer data stored in its memory to a central computer for processing. However, where a data collection terminal must operate for long periods of time, e.g., at remote sites, vehicle mounted docks are needed to recharge the data collection terminal's batteries in the field. The vehicle dock may also provide for data communication during battery recharge. Examples of such data communication include wireless links such as RF, cellular telephone, etc., whereby inventory, sales, or delivery information may be transmitted prior to the end of an operator's shift or completion of a route, communication with a portable printer to provide a hard copy such as an invoice or delivery ticket, communication with a fax and/or modem, etc.

A vehicle dock should provide positive retention of the data terminal while the vehicle is in motion. As many operators may not be inclined toward painstaking or precise manipulations, a vehicle docking apparatus should be quickly and simply operated. It would be highly advantageous to provide a data terminal docking apparatus which can be quickly and simply operated and which requires a minimum of attention and care from operators, while also providing extremely secure retention of the data terminal.

SUMMARY OF THE INVENTION

The present invention relates to an apparatus for docking a portable data collection terminal in a vehicle such as a delivery truck, van or the like. It is an object of the present invention to provide an apparatus which facilitates ease of insertion and removal by an operator and provides secure retention of a portable data collection terminal while providing reliable interconnections between a portable data collection terminal and an electrical power source and/or a data communication connections in a moving vehicle, which may subject a docked terminal to bumps and jolts.

The vehicle dock according to the present invention comprises a housing which may be mounted to a surface within the interior cabin of a vehicle, a terminal cup mounted within the housing, and a pivoting front panel. The vehicle dock preferably further comprises a member, means, or mechanism for providing initial retention and alignment of the data terminal in the vehicle dock to assure proper alignment prior to securing the terminal via the pivoting front panel. The initial retention and alignment means preferably corresponds to an external feature of a data terminal housing, such as a snap latch aligned with a strap holder on a data collection terminal. The initial alignment and retention thereby provided serves to temporarily retain the data terminal when it is initially placed in the dock until it is more securely retained by the pivoting front panel. By assuring proper alignment, potential damage to the data terminal can be avoided and a secure electrical and/or communication coupling can be provided. Other examples of means for initially retaining and aligning the data terminal include, for example, grooves or channels in the terminal cup corresponding to external features of a data collection terminal (e.g., to provide a keyed fit between the data terminal and the terminal cup), guide rollers, resilient protrusions which engage a complementary depression or indentation on a data terminal housing, etc.

After the initial retention and alignment of the data terminal, the data terminal is secured in the dock by a second retention means such as a front panel which pivots to secure and release the data terminal. The front panel may include an opening allowing access to the data terminal display screen and/or keypad while the data terminal is docked, or, through which a pistol grip of a portable data collection terminal may protrude when it is placed in the dock. The front panel pivots about a horizontal axis between an open and closed position to allow insertion and removal of the portable data collection terminal.

A handle assembly rotates a cam mounted within the housing to secure and release the unit from the docking apparatus. A lock may be provided, either in the handle assembly or on the housing adjacent thereto, to prevent theft of the data terminal. In a preferred embodiment, the cam operates a spring loaded lever which tends to urge the docking apparatus to the open position unless the force of the spring is overcome by the cam upon rotation of the handle assembly by the operator. In an especially preferred embodiment, the rotating cam is shaped such that slight rotations of the handle will cause a self-return to either the open or locked position. In another especially preferred embodiment, the lever attached to the front panel and urged by the cam comprises an adjustment screw that allows precise positioning of the lever with respect to the cam to eliminate all tolerance from the system at final assembly.

In an especially preferred embodiment, a U-shaped bracket is mounted to the base of the housing for carrying the pivot points, and employing a front panel attached to a downward extending lever engaging the cam. In this especially preferred embodiment, two springs are employed, and are externally (with respect to the downward extending lever) mounted on the front panel between elevated bosses on the front edge of the base plate of the housing.

BRIEF DESCRIPTION OF THE DRAWINGS

The detailed description of the invention may be best understood when read in reference to the accompanying drawings wherein.

DETAILED DESCRIPTION OF THE INVENTION

Figure 1A:
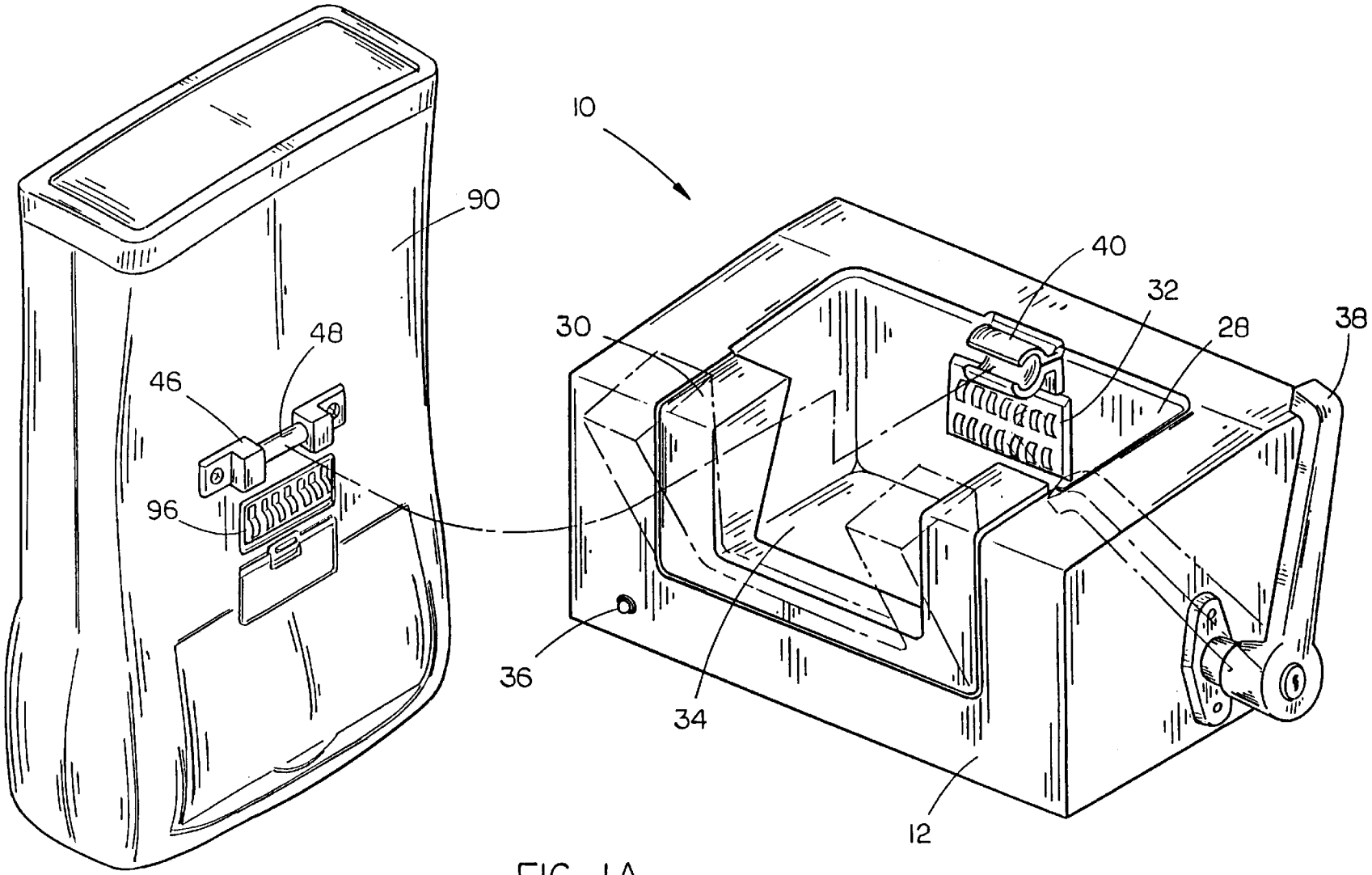
FIGS. 1A and 1B are front and rear views, respectively, illustrating a vehicle docking apparatus according to an exemplary embodiment of the present invention.
Figure 1B:
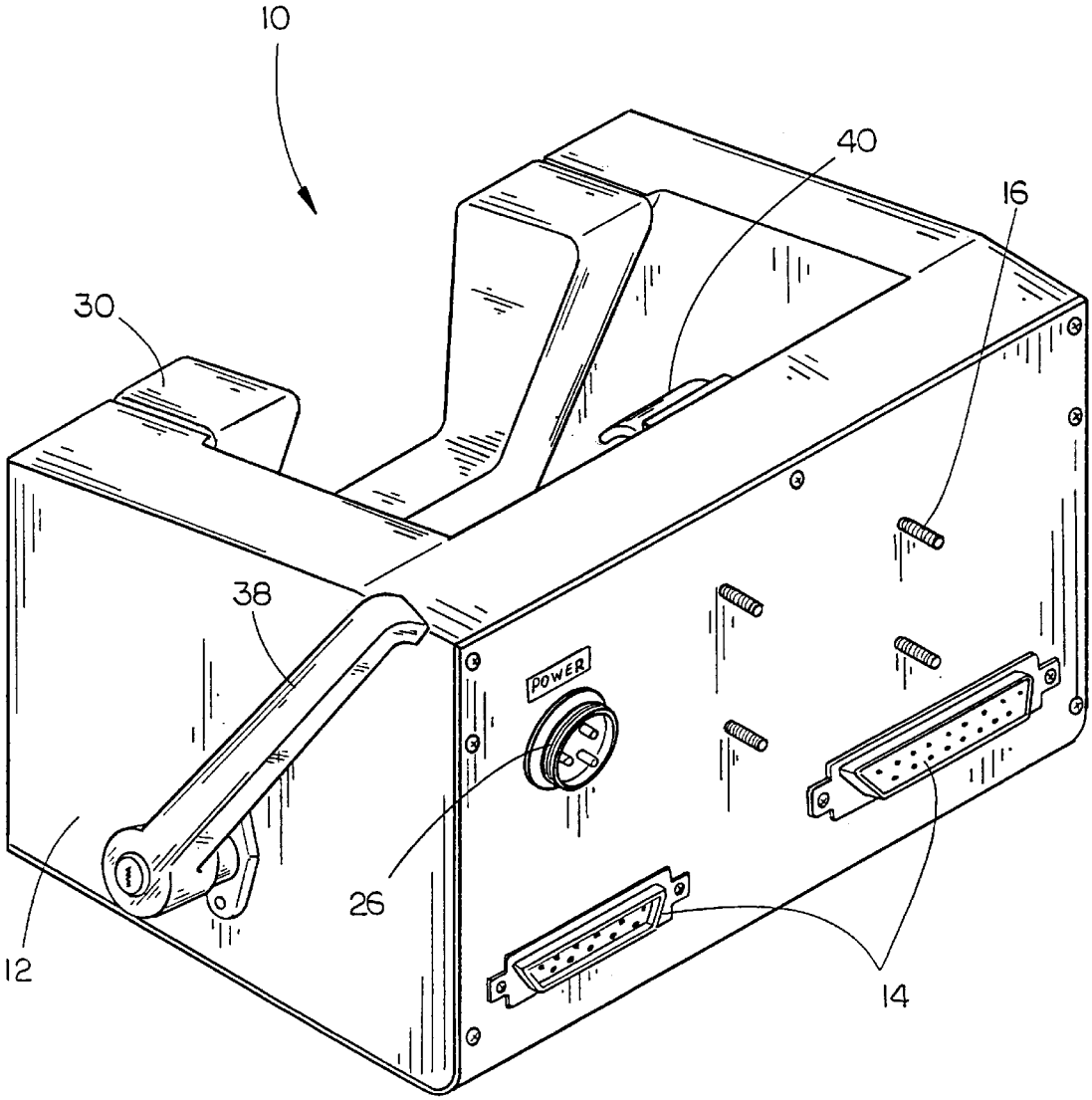

Referring now to the drawings, FIGS. 1A, 1B, 8A, and 8B depict perspective front and rear views of exemplary embodiments of vehicle dock 10 according to the present invention. Preferably, vehicle dock 10 comprises a housing 12 that may be mounted to a surface within the interior cabin of a vehicle such as a truck, delivery van, or the like.

Rear cover plate 22 is shown with mounting posts 16 for mounting to an interior surface of a vehicle, although other means of mounting may be employed such as slotted openings, and the like. The configurations shown in FIGS. 1B and 8B have mounting posts 16 on rear cover plate 22 and is thus suitable for mounting on a vertical surface, however, where mounting on a horizontal surface is desired the desired mounting means may be located on bottom cover plate 20 (FIGS. 2 and 9), thus allowing mounting on a horizontal or vertical surface. An electrical connector 26 is shown extending through housing 12 to provide interconnection between the docked data collection terminal and an electrical power source, such as the vehicle's electrical system. Data ports 14 may also provide interconnection between the data collection terminal and peripheral devices such as a radio transceiver, computer, printer, modem, or the like.

A terminal cup 28, into which the portable data collection terminal may be removably inserted, is mounted within housing 12. Preferably, the interior shape of the terminal cup 28 conforms to the exterior shape of a data terminal housing such that the data terminal is held securely within terminal cup 28 by a pivoting front panel 30 when vehicle dock 10 is in closed position, and wherein a steady electrical connection is made between the electrical contacts 96 of the data terminal 90 and electrical contacts 32 of vehicle dock 10 when data terminal 90 is inserted and locked by the user into vehicle dock 10.

The terminal cup 28 and rotating front panel 30 are depicted as having a frontal opening 34 to allow access by the user to the keyboard and display of the data terminal, or to allow docking of a data terminal having a pistol grip.

Electrical contacts 32 are disposed on an inside surface of the terminal cup 28. These contacts 32 may comprise surface contacts or the like which mate with complementing contacts 96 on the housing of a data collection terminal 90 to provide electrical interconnection between the data terminal 90 and vehicle dock 10. The placement of the electrical contacts on terminal cup 28 is dictated by the placement of contacts on the data terminal which is to be docked in vehicle dock 10. For example, in alternative embodiments of the invention (not shown), the electrical contacts 32 may be located on the base of terminal cup 28 when the data terminal desired to be docked also contains electrical contacts on the base of the data terminal housing, or on a side surface of the terminal cup when the data terminal contacts are located on the side of the data terminal, etc. An indicator light 36 which may be, for example, an LED, may be located on housing 12 to indicate when current is flowing between vehicle dock 10 and the data terminal. The indicator light may be used, for example, to indicate when the data terminal battery is being charged, when the data terminal is being operated by the electrical system of the vehicle, when data transfer is taking place, etc.

Figure 8A:
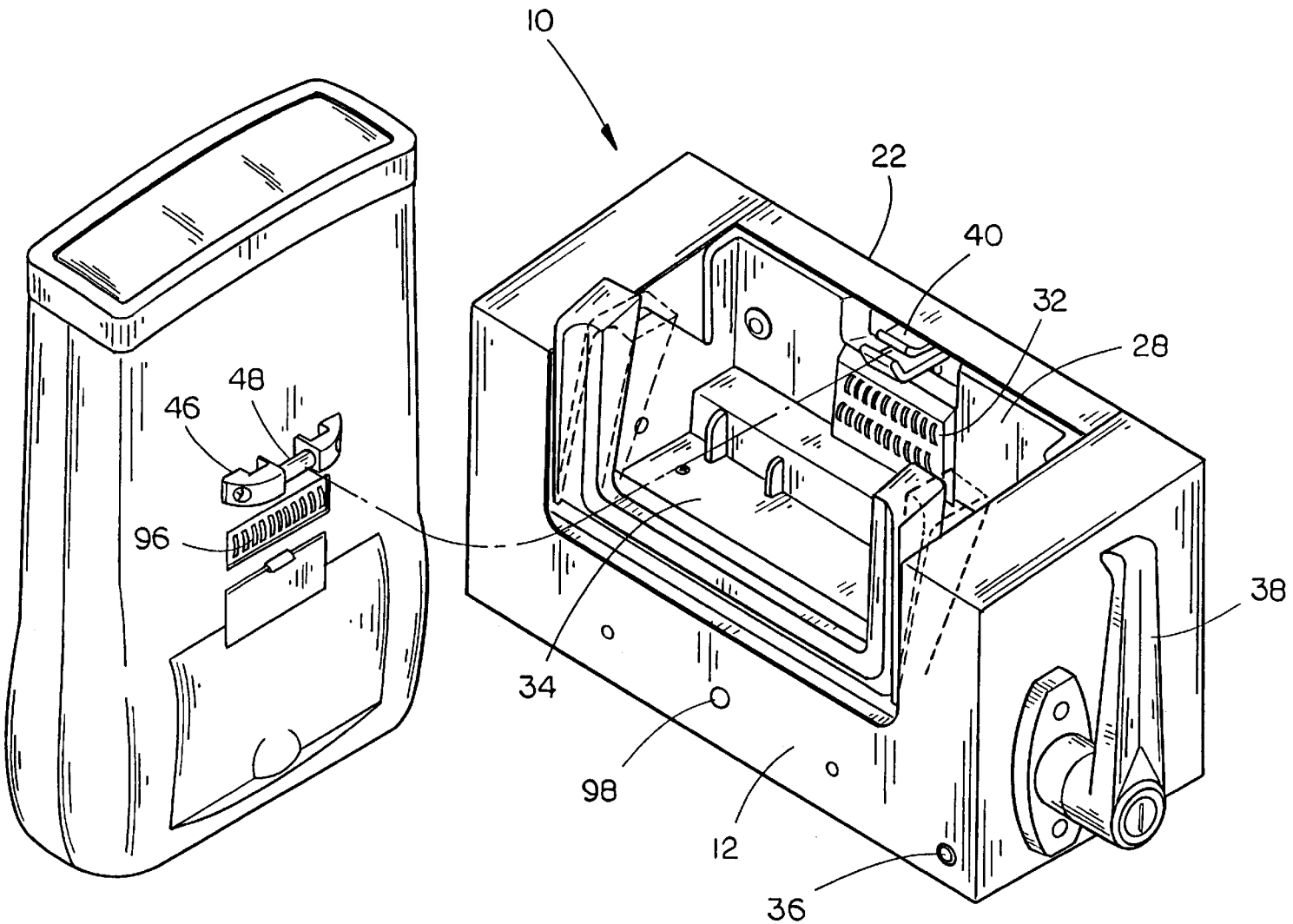
FIGS. 8A and 8B are front and rear views, respectively, illustrating a vehicle docking apparatus according to a preferred embodiment of the present invention.
Figure 8B:
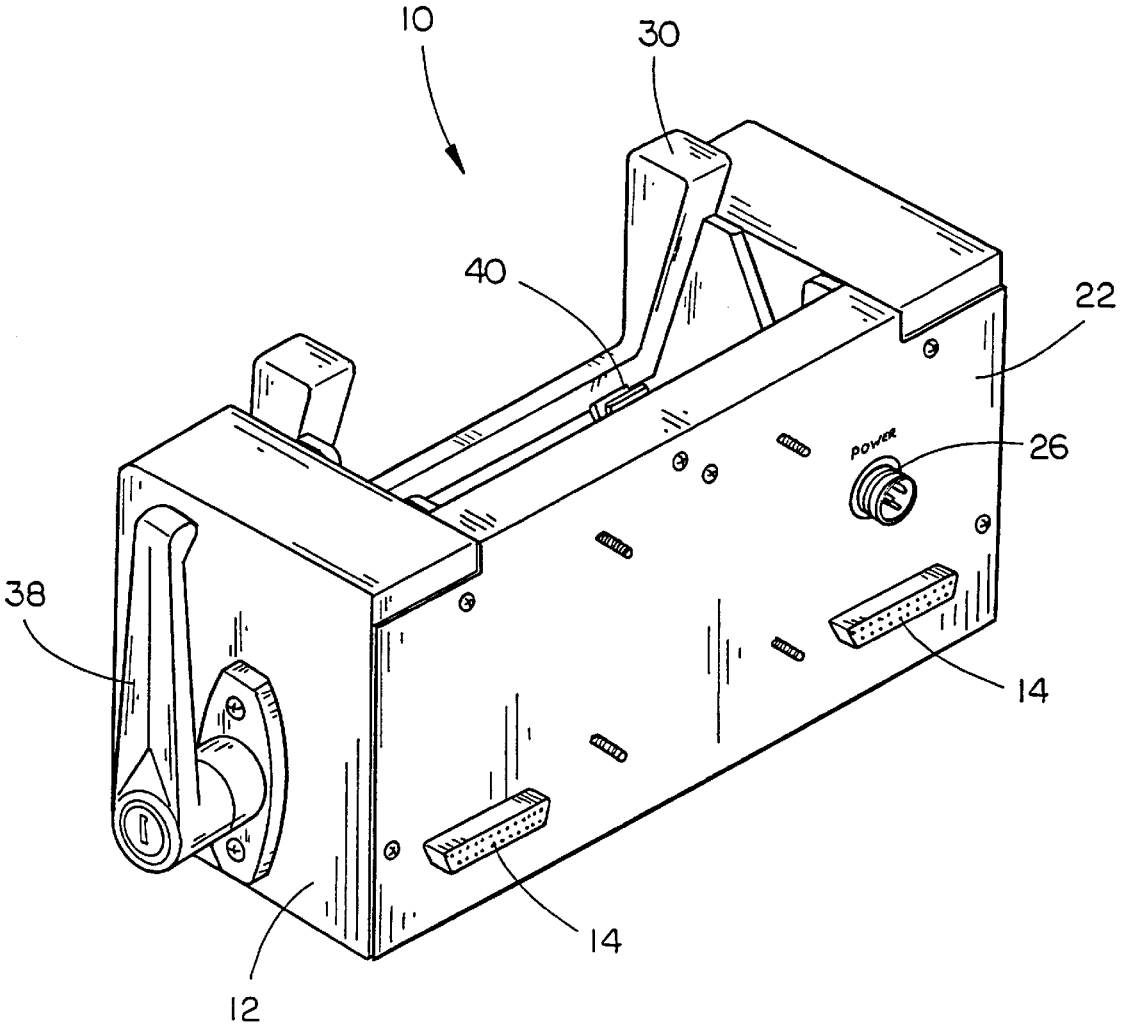
Figure 9:
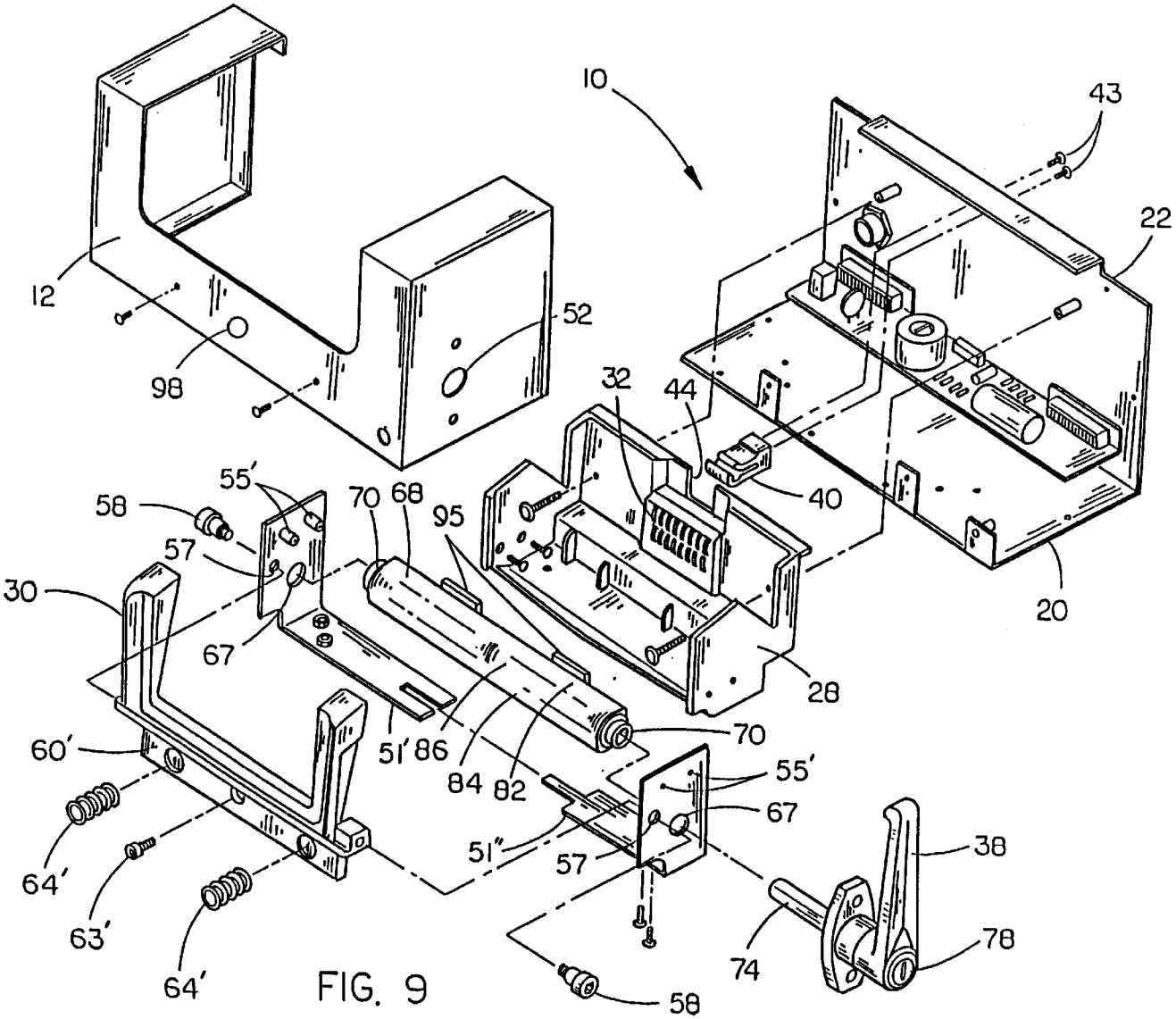
FIG. 9 is an exploded view of an especially preferred embodiment of a vehicle docking apparatus according to the present invention.

To dock the portable data collection terminal in vehicle dock 10, vehicle dock 10 is set to the "open" position by rotating handle 38 forward. In FIG. 1A, handle 38 is depicted in "closed" position by solid lines, and in "open" position by phantom lines. In FIG. 8A, handle 38 is depicted in "open" position by solid lines, and in "closed" position by phantom lines. Rotating handle 38 in a forward direction (toward the user) urges pivoting front panel 30 forward to its "open" position. FIG. 1A depicts front panel 30 in "closed" position by solid lines and in "open" position by phantom lines. FIG. 8A depicts front panel 30 in "open" position by solid lines and in "closed" position by phantom lines. When dock 10 is in open position, a data terminal may be inserted into terminal cup 28 and is preferably retained by an initial alignment and retention means which engages with a surface feature of the data terminal. The initial alignment and retention means depicted is a snap latch 40 which engages with a data terminal strap holder 46 having a round cross sectional member 48 which engages with snap latch 40. Snap latch 40 is attached to terminal cup 28 via snap latch clip 42 (FIG. 2) or retaining screws 43 (FIG. 9), and is preferably accommodated by a molded feature 44 (FIGS. 2 and 9) on terminal cup 28. The location of snap latch 40 is determined by the location of strap holder 46 or other corresponding feature on the housing of the data collection terminal. The snap latch 40 may alternatively be an integrally molded feature, or alternatively, a co-molded feature, of terminal cup 28 or housing 12 or may attach to rear housing cover plate 22 (FIGS. 2 and 9) via screws 43 (FIG. 9). Although the embodiments shown depicts a snap latch, other initial alignment and retention means may alternatively include, for example, in embodiments not shown, grooves or channels within terminal cup 28, resilient protrusions, and the like, to conform to the exterior shape or exterior features of a data terminal housing, and the configuration utilized will depend on the particular data terminal to be utilized with the vehicle dock. Alternatively, in an embodiment not shown, the electrical contacts themselves may serve as the initial alignment and retention means. The exemplary embodiment of vehicle dock 10 shown in the drawings is adapted for use with a data terminal having a strap holder on its housing, such as the NORAND® 6300 data terminal, although the invention can readily be adapted to other units as well.

After the data terminal is placed in terminal cup 28 and removably retained by snap latch 40, the handle 38 is rotated from open position to closed position whereby the pivoting front panel 30 is urged to its closed position, the front panel 30 thereby providing a second retaining means and securing the data terminal within dock 10. To remove the data terminal from vehicle dock 10, the procedure is reversed. Handle 38 is rotated to its open position whereby front panel 30 is likewise returned to its open position and wherein the data terminal may be grasped by the user and removed from the initial alignment and retention means and then from the vehicle dock.

Figure 2:
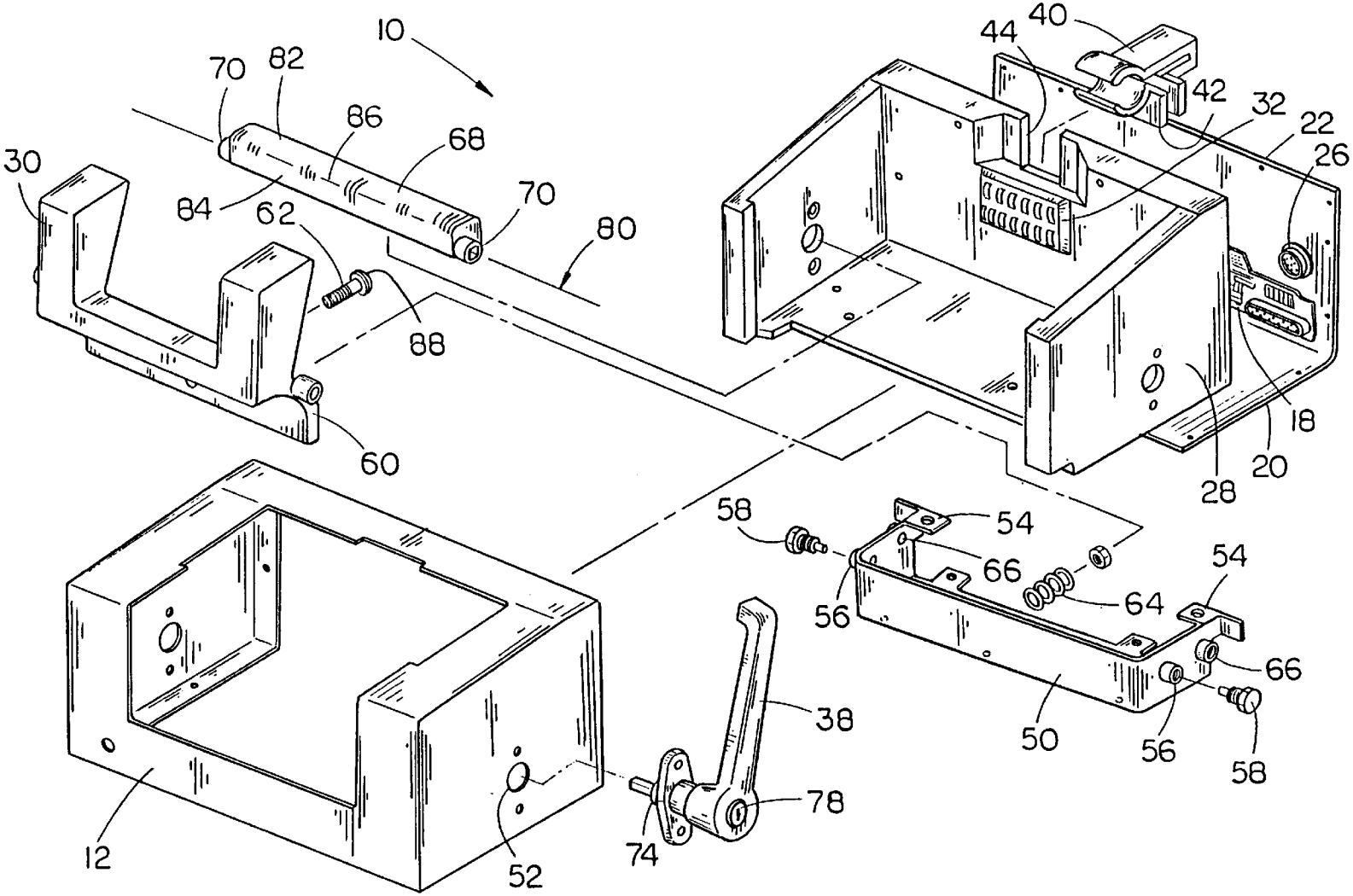
FIG. 2 is an exploded view of one embodiment of a vehicle docking apparatus according to the present invention.

Referring now to FIG. 2, there is depicted a first embodiment of vehicle dock 10 according to the present invention, shown in exploded view, comprising housing 12, snap latch 40 with snap latch locating clip 42, data terminal strap holder 46 comprising round cross section 48, terminal cup 28 and molded feature 44, and electrical contacts 32. Electrical contacts 32 are coupled to circuit board 18, providing electrical coupling to the vehicle's power supply or other external power supply, and for data communication via ports 14 (FIG.1 B). Housing 12 comprises handle openings 52 on each side for left and right attachment of handle 38. C-shaped bracket 50 is mounted within housing 12 and comprises pivot holes 56 for retaining front panel 30 via hinge pin pivot bolts 58. Pivoting front panel 30 is attached to downward extending lever 60 containing set screw 62. Terminal cup 28 is mounted to C-shaped bracket 50 via terminal cup mounts 54. The C-shaped bracket 50 also contains mounted thereon coil spring 64 urging front panel 30 to the open position, and which is compressed when front panel 30 is in closed position. C-shaped bracket 50 also comprises pivot holes 66 for square tube or cam 68. By square tube, as used throughout this disclosure, is meant a tube or bar having a generally square-shaped cross-section. Square tube 68 comprises hinge pins 70. Handle 38 is attached to shaft 74 through handle openings 52 in housing 12 and pivot holes 66 in C-shaped bracket 50. In an embodiment not shown, square tube may optionally contain an open portion, such as a two- or three-sided welded end, and the like, to allow access to end of shaft 74 when it is engaged to square tube 68, e.g., for capture of shaft 74 by jam nuts, etc. Handle 38 preferably includes a lock 78 to prevent theft of the data terminal.

The axis of rotation 80 of tube 68 is offset from center such that the distance from the axis 80 to side 82 of tube 68 engaging set screw 62 when front panel 30 is in the upright closed position is greater than the distance from axis 80 to side 84 of tube 68 engaging set screw 62 when front panel 30 is in open position. The corner edge 86 of square tube 68 between sides 82 and 84 is preferably rounded and set screw 62 may advantageously further comprise a large radius stainless steel cap 88. Set screw 62 can be adjusted to eliminate all tolerance from the system at final assembly.

The distance between the axis of rotation 80 and side 84 is sufficiently small to enable front panel 30 to rotate or pivot to an open position via the urging of spring 64 on downward extending lever 60. The distance between axis 80 and side 82 is sufficiently great such that upon rotation of handle 38 to the closed position, downward extending lever 60 will be urged to the vertical closed position, providing secure docking for a data terminal. The distance from axis 80 to corner edge 86 is preferably greater than the distance from axis 80 to either side 82 or 84, such that slight rotations of handle 38 will result in a self-return to either open or closed position as a result of the force of spring 64. The relationships between the sides of square tube 68 and the axis of rotation 80 can be better seen in FIGS. 4 and 5.

Figure 3:
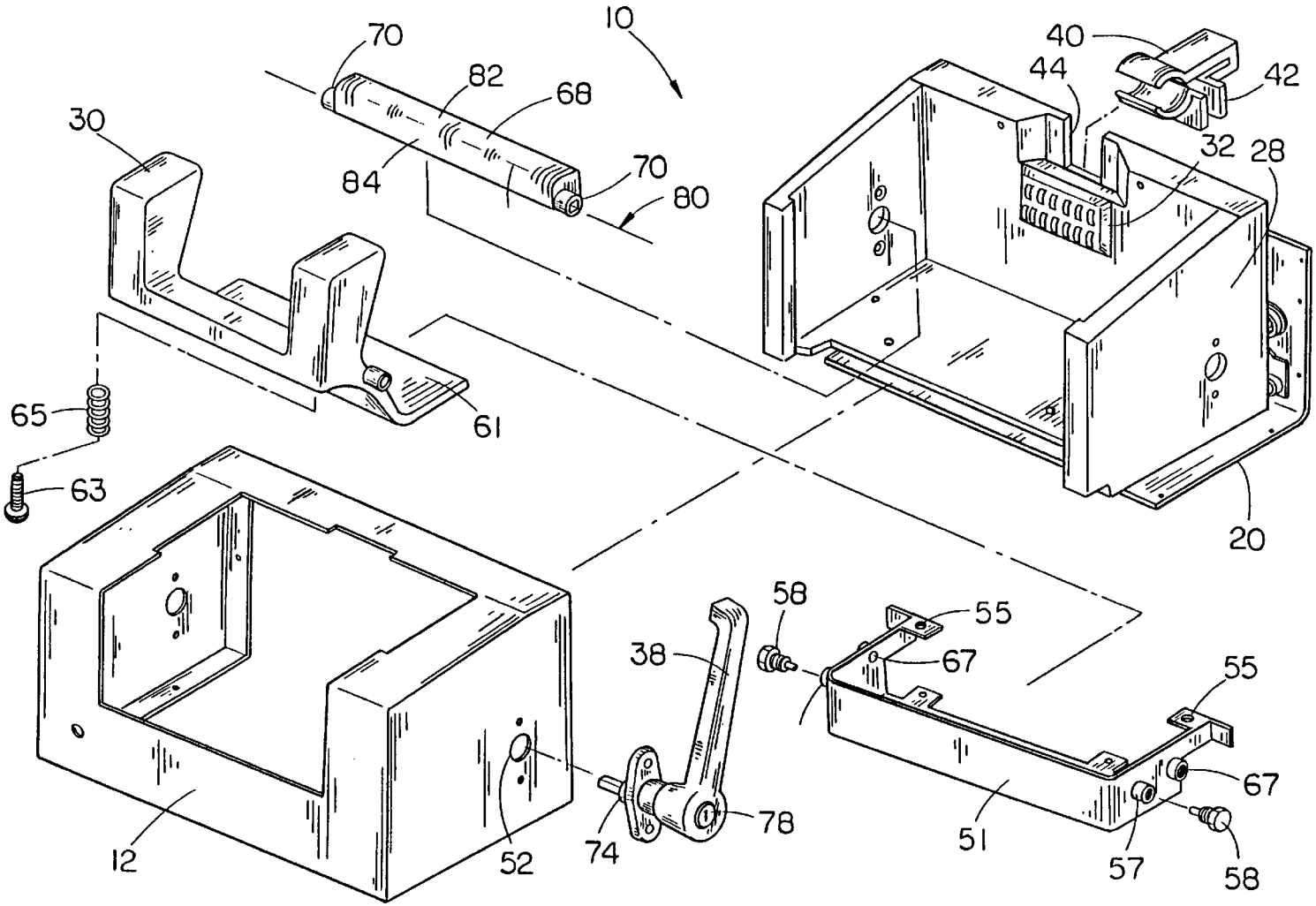
FIG. 3 is an exploded view of an alternative embodiment of a vehicle docking apparatus according to the present invention.

Referring now to FIG. 3, there is shown a second embodiment of vehicle dock 10 according to the present invention, shown in exploded view, depicting snap latch 40 with snap latch locating clip 42, terminal cup 28 and molded feature 44, and electrical contacts 32. U-shaped bracket 51 is mounted within housing 12 and comprises pivot holes 57 for retaining front panel 30 via pivot bolts 58. Pivoting front panel 30 is attached to horizontally extending lever 61. Lever 61 is also shown with set screw 63 which is used for precise positioning of lever 61 to eliminate all tolerance from the system at final assembly. Terminal cup 28 is mounted on U-shaped bracket 51 via terminal cup mounts 55. The U-shaped bracket 51 also contains mounted thereon spring 65 urging lever 61 upward and front panel 30 to the open position, and which is compressed when front panel 30 is in closed position. U-shaped bracket 51 also comprises pivot holes 67 for square tube 68 and preferably will allow positioning handle 38 on both the right and left side. Square tube 68 comprises hinge pins 70. Handle 38 is attached to shaft 74 which fits into hinge pin 70. Handle 38 preferably includes a lock 78 to prevent theft of the data terminal.

The axis of rotation 80 of tube 68 is offset from center such that the distance from the axis 80 to side 82 of tube 68 engaging set screw 63 when front panel 30 is in the upright closed position is greater than the distance from axis 80 to side 84 of tube 68 engaging set screw 63 when front panel 30 is in open position. The corner edge 86 of square tube 68 between sides 82 and 84 is preferably rounded.

The distance between the axis of rotation 80 and side 84 is sufficiently small to enable front panel 30 to rotate to an open position via the upward urging of spring 65 on horizontally extending lever 61, thereby pivoting front panel 30 outward. The distance between axis 80 and side 82 is sufficiently great such that upon rotation of handle 38 to the closed position, horizontally extending lever 61 will be urged to the horizontal closed position, thus providing secure docking for a data terminal. The distance from axis 80 to corner edge 86 is preferably greater than the distance from axis 80 to either side 82 or 84, such that slight rotations of handle 38 will result in a self-return to either open or closed position as a result of the force of spring 65. The relationships between the sides of square tube 68 and the axis of rotation 80 can be better seen in FIGS. 6 and 7.

Figure 5:
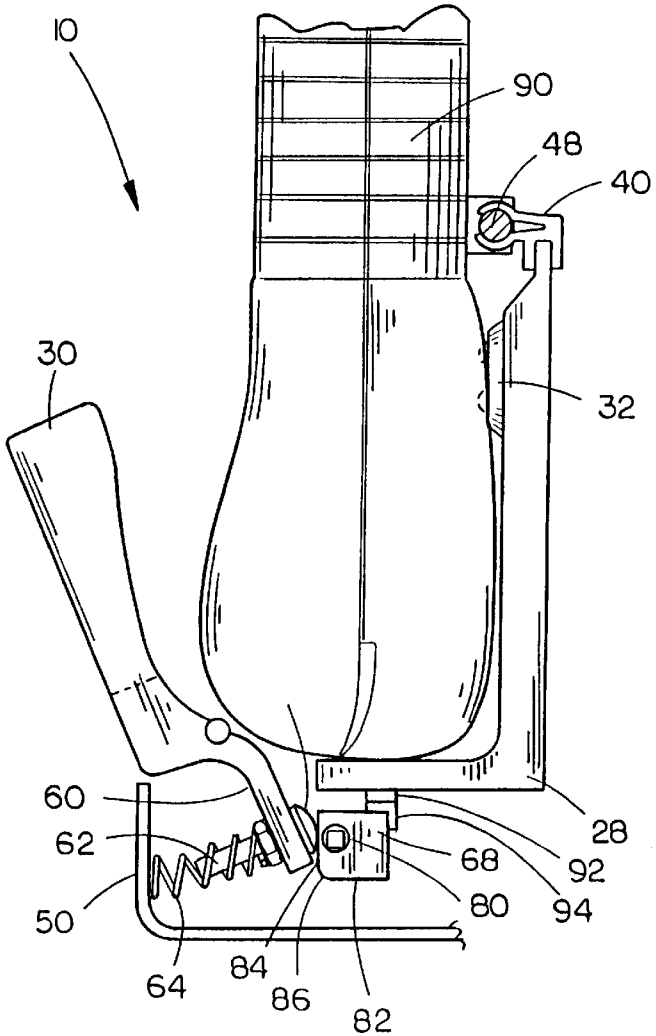
FIGS. 4 and 5 are cut away side views of an embodiment according to the present invention similar to that shown in FIG. 2 employing a downward extending lever showing the dock in closed and open positions, respectively.
Figure 4:
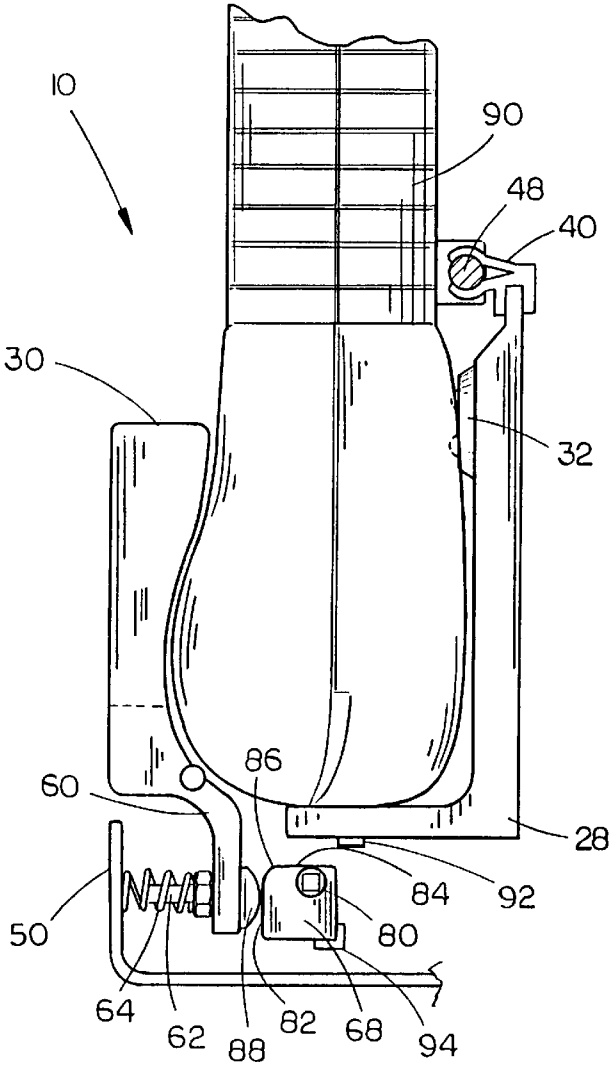
Figure 7:
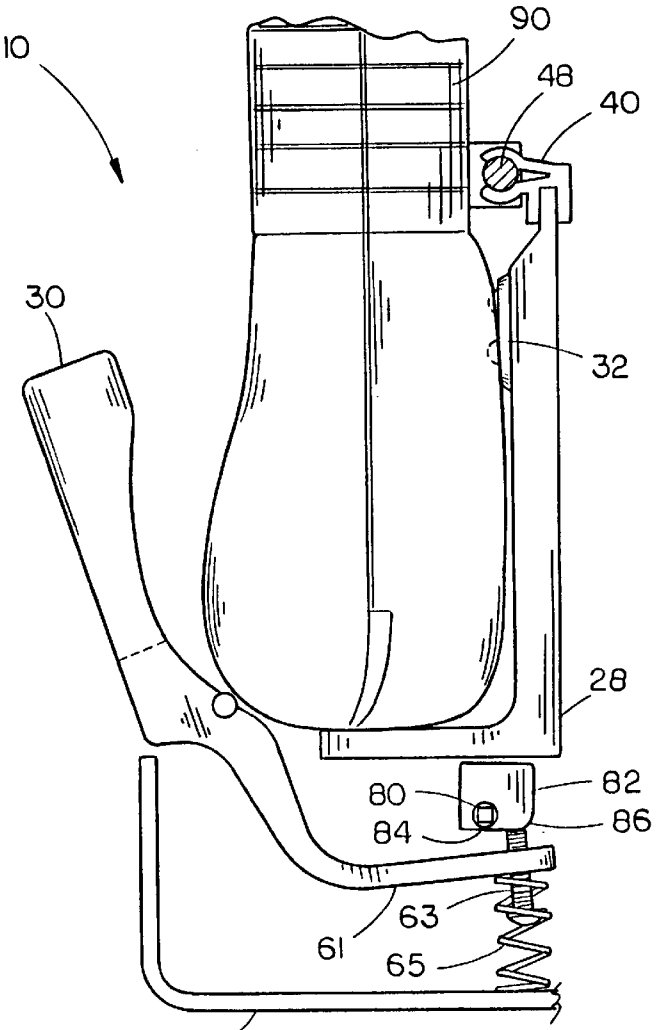
FIGS. 6 and 7 are sectional side views of an embodiment according to the present invention similar to that shown in FIG. 3 employing a horizontally extending lever showing the dock in closed and open positions, respectively.
Figure 6:
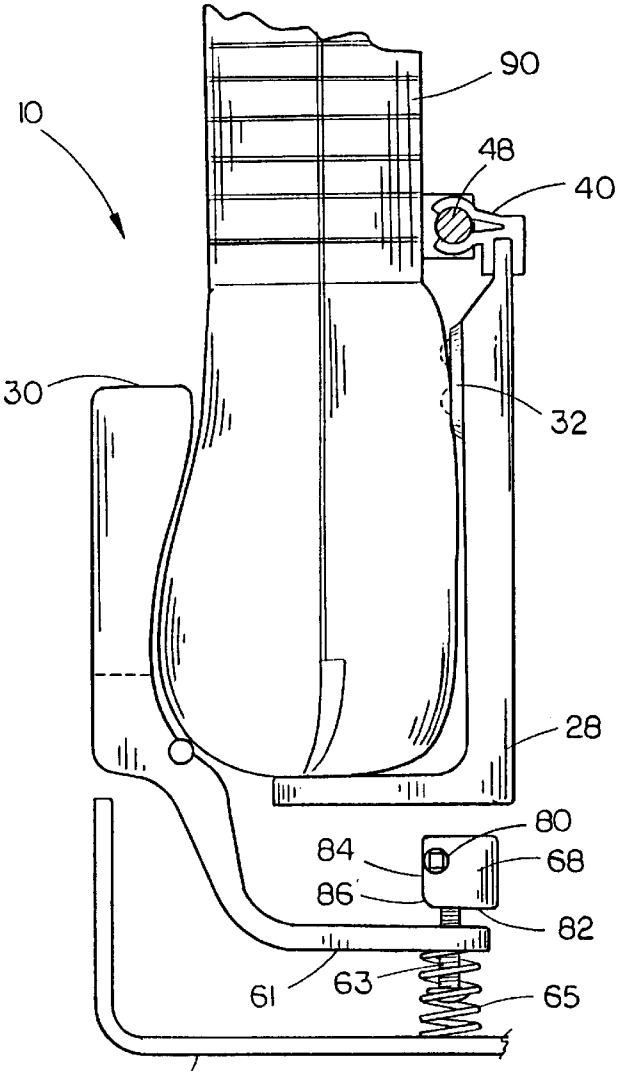

FIGS. 4–7 are sectional views of vehicle dock 10 according to the present invention, having data terminal 90 mounted therein, to more clearly demonstrate the shape of square tube 68 and the placement of the axis of rotation 80 with respect to sides 82 and 84. FIGS. 4 and 5 show the embodiment of vehicle dock 10 employing downward extending lever 60, as shown in FIG. 2, with FIG. 4 showing vehicle dock 10 in closed position and FIG. 5 showing vehicle dock 10 in open position. FIGS. 6 and 7 show the embodiment of vehicle dock 10 employing horizontally extending lever 61, as shown in FIG. 3, with FIG. 6 showing vehicle dock 10 in closed position and FIG. 6 showing vehicle dock 10 in open position. FIGS. 4 and 5 also illustrate a preferred method of limiting handle relief, wherein rotation of the handle beyond the open position is prevented by welded member 94 on square tube 68 abuts with protrusion 92 on terminal cup 28. Other means of limiting handle relief may also be employed, including a notched handle assembly and correspondingly shaped or keyed handle opening, cams on handle assembly in conjunction with stops or posts within housing, on C-shaped or U-shaped brackets, or on the terminal cup.

Referring now to FIG. 9, there is shown a preferred embodiment of vehicle dock 10 according to the present invention, shown in exploded view, depicting snap latch 40, attached to rear plate 22 via screws 43 and extending through molded feature 44 in terminal cup 28, and electrical contacts 32. A U-shaped bracket is formed by the union of L-shaped members 51' and 51", and is mounted within housing 12 and comprises pivot holes 57 for retaining front panel 30 via pivot bolts 58. The U-shaped bracket formed by L-shaped members 51' and 51" is attached to bottom plate 20. Pivoting front panel 30 is attached to downward extending lever 60'. Terminal cup 28 is mounted on L-shaped members 51' and 51" via terminal cup mounting bosses 55'. The U-shaped bracket formed by L-shaped members 51' and 51" further comprises pivot holes 67 pivotally engaging cam 68 via hinge pins 70. Springs 64' mounted between lever 60' and the interior surface of housing 12 urge lever 60' inward, thus urging front panel 30 to the open position. Springs 64' are compressed by the urging of cam 68 upon lever 60', thereby causing front panel 30 to pivot to its closed position. Handle 38 engages cam 68 via shaft 74 extending through an aperture 52 in housing 12. Shaft 74 is secured to handle 38 and which engages hinge pin 70. Handle 38 preferably includes a lock 78 to prevent theft of the data terminal.

Lever 60' may be provided with one or more set screws 63' (one depicted) which is used for precise positioning of lever 60' to eliminate all tolerance from the system at final assembly. Adjustment screw 63 is preferably provided with the threaded portion extending through the lever 60' and engaging the cam 68, and which can preferably be adjusted on the front surface of the downward extending lever 60'. The degree of rotation may be limited by providing abutting member 95. Preferably, the head of the adjustment screw is substantially flush with front surface of downward extending lever 60', and is adjusted with a hex wrench or the like. In a particularly preferred embodiment, the adjustment screw may be accessed through housing 12 via aperture 98 in housing 12, thus allowing adjustments to be made conveniently without the need for disassembling the unit for access.

Figure 11:
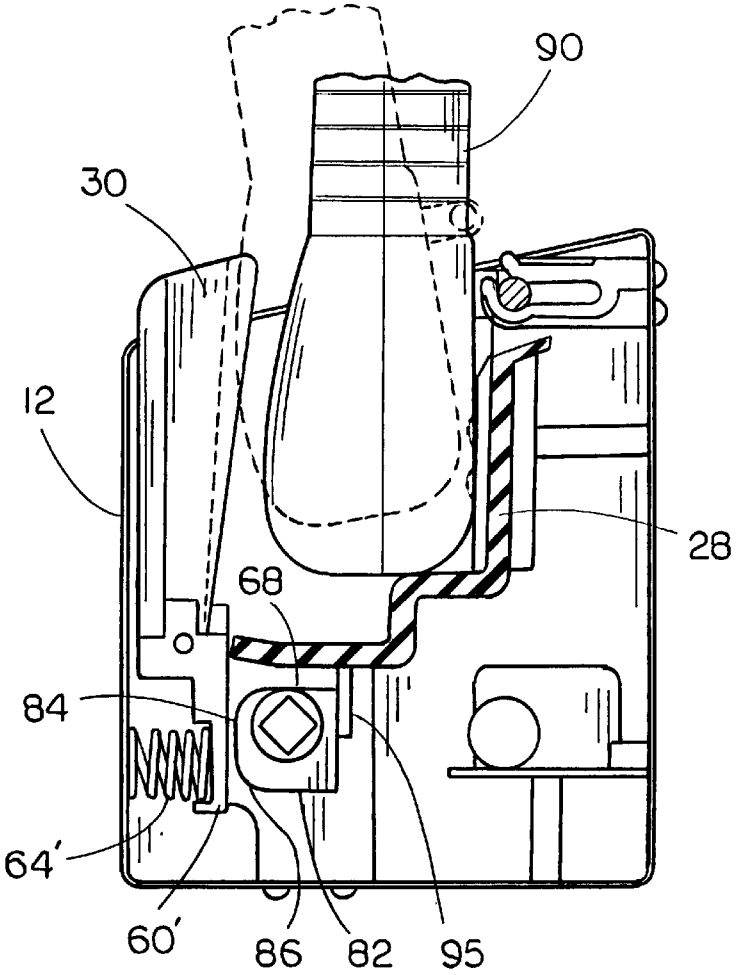
FIGS. 10 and 11 are sectional side views of an embodiment according to the present invention similar to that shown in FIG. 9, showing the vehicle dock in closed and open positions, respectively.
Figure 10:
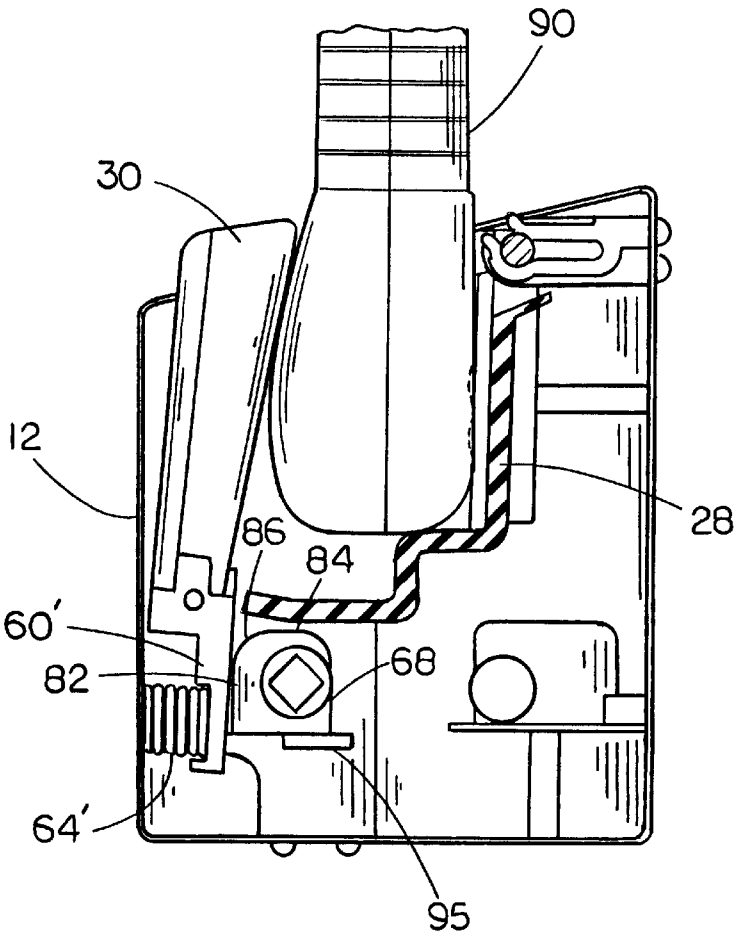

FIGS. 10 and 11 depict the relationships between the lever 60' and sides 82 and 84 and corner 86 of cam 68 in the embodiment shown in FIG. 9.

The axis of rotation of cam 68 is offset from center such that the distance from the axis to side 82 of cam 68 engaging lever 60' is greater than the distance from axis to side 84 of cam 68. When the handle is rotated such that side 82 engages lever 60', lever 60' will be urged against the force of springs 64', moving lever 60' outward causing front panel 30 to be pivoted inward to secure data terminal 90.

The distance from side 84 to the axis of rotation is sufficiently small that when the handle is rotated such that side 84 of cam 68 engages lever 60', springs 64' may urge lever 60' inwardly and front panel 30 outwardly, allowing data terminal 90 to be removed from dock 10. The position of data terminal 90 as it is being removed from dock 10 is shown in phantom lines (FIG. 11). The corner edge 86 of cam 68, where sides 82 and 84 meet, is preferably rounded.

The distance from axis to corner edge 86 is preferably greater than the distance from axis to either side 82 or 84, such that slight rotations of handle 38 will result in a self-return to either open or closed position as a result of the force of springs 64'.

The description above should not be construed as limiting the scope of the invention, but as merely providing illustrations to some of the presently preferred embodiments of this invention. In light of the above description and examples, various other modifications and variations will now become apparent to those skilled in the art without departing from the spirit and scope of the present invention as defined by the appended claims. Accordingly, the scope of the invention should be determined solely by the appended claims and their legal equivalents.

What is claimed is:

1. A vehicle docking apparatus for docking a portable data collection terminal in a vehicle, said vehicle docking apparatus comprising:

a housing;

an electrical connector for coupling a data collection terminal and an electrical power source;

a terminal cup mounted in said housing into which said portable data collection terminal may be removably inserted;

a handle assembly comprising a handle rotatably attached to a cam, said cam rotatably mounted in said housing; and a retaining member for securing a data terminal, said retaining member comprising a lever attached to a front panel, said lever pivotally mounted within said housing and said lever engaging said cam, said front panel pivotally moveable between a closed position securing said data terminal and an open position releasing said data terminal, wherein movement of said front panel is communicated by movement of said cam against said lever.

2. The vehicle docking apparatus according to claim 1, wherein said front panel includes an opening.

3. The vehicle docking apparatus according to claim 2, wherein said opening allows access to a data terminal display screen and keypad while the data terminal is docked.

4. The vehicle docking apparatus according to claim 1, comprising an electrical connector for electrically coupling a data collection terminal to an electrical system of a vehicle.

5. The vehicle docking apparatus according to claim 1, further comprising one or more springs mounted within said housing engaging said lever and urging said front panel to said open position.

6. The vehicle docking apparatus according to claim 5, wherein said cam comprises a generally rectangular-shaped cross-section, said cam rotatably mounted within said housing, said cam rotatable between a first and second position, wherein a first side of said cam faces said lever when the retaining member is in said open position, and wherein a second side of said cam faces said lever when the retaining member is in said closed position.

7. The vehicle docking apparatus according to claim 6, wherein said axis of rotation of the cam is offset from center.

8. The vehicle docking apparatus according to claim 6, wherein said first side of said cam and said second side of said cam are adjacent sides, whereby an edge is formed therebetween.

9. The vehicle docking apparatus according to claim 8, wherein said edge is rounded.

10. The vehicle docking apparatus according to claim 1, further comprising a lock for locking a data terminal vehicle in the docking apparatus.

11. The vehicle docking apparatus according to claim 10, wherein the lock is located within the handle assembly.

12. The vehicle docking apparatus according to claim 10, wherein the lock is located within the housing.

13. The vehicle docking apparatus according to claim 1, wherein said lever further comprises an adjustment screw for adjusting the position of the lever with respect to the cam.

14. The vehicle docking apparatus according to claim 1, wherein said cam comprises a generally rectangular-shaped cross-section, said cam rotatably mounted within said housing, said cam rotatable between a first and second position, wherein a first side of said cam faces said lever when the retaining member is in said open position, and wherein a second side of said cam faces said lever when the retaining member is in said closed position.

15. The vehicle docking apparatus according to claim 14, wherein said axis of rotation of the cam is offset from center.

16. The vehicle docking apparatus according to claim 14, wherein said first side of said cam and said second side of said cam are adjacent sides, whereby an edge is formed therebetween.

17. The vehicle docking apparatus according to claim 16, wherein said edge is rounded.

18. The vehicle docking apparatus according to claim 1, comprising means for aligning a data terminal within the docking apparatus.

19. The vehicle docking apparatus according to claim 1, comprising an alignment member for aligning a data terminal within said docking apparatus, said alignment member shaped to engage feature on the surface of the data terminal.

20. The vehicle docking apparatus according to claim 19, wherein said alignment member comprises a snap latch.

21. The vehicle docking apparatus according to claim 20, wherein said snap latch attaches to said terminal cup via a clip.

22. The vehicle docking apparatus according to claim 20, wherein said snap latch attaches to said terminal cup via one or more screws.

23. The vehicle docking apparatus according to claim 20, wherein said snap latch is integrally molded to said housing or to said terminal cup.

24. The vehicle docking apparatus according to claim 20, wherein said snap latch is co-molded to said housing or to said terminal cup.

25. The vehicle docking apparatus according to claim 1, further comprising an indicator light for providing a visual indication of a data transfer operation.

26. The vehicle docking apparatus according to claim 1, further comprising an indicator light for providing a visual indication of a battery recharge operation.

27. A vehicle docking apparatus for docking a portable data collection terminal in a vehicle, said vehicle docking apparatus comprising:

a housing;

an electrical connector for coupling a data collection terminal and an electrical power source;

a terminal cup mounted in said housing into which said portable data collection terminal may be removably inserted;

an initial alignment and retaining member for providing alignment of said data terminal within said docking apparatus and for removably retaining a data collection terminal within the docking apparatus, said alignment and retaining member engaging an external feature of said data terminal;

a handle assembly comprising a handle rotatably attached to a cam, said cam rotatably mounted in said housing; and a retaining member for securing a data terminal, said retaining member comprising a lever attached to a front panel, said lever pivotally mounted within said housing and said lever engaging said cam, said front panel pivotally moveable between a closed position securing said data terminal and an open position releasing said data terminal, wherein movement of said front panel is communicated by movement of said cam against said lever.

28. A vehicle docking apparatus for docking a portable data collection terminal in a vehicle, said vehicle docking apparatus comprising:

a housing;

means for electrically coupling a data collection terminal to an electrical power source;

a terminal cup mounted in said housing into which said portable data collection terminal may be removably inserted a first retention means for at least partly securing a data terminal within the docking apparatus;

a handle assembly comprising a handle rotatably attached to a cam, said cam rotatably mounted in said housing; and a second retention means for securing a data terminal, said second retention means comprising a lever attached to a front panel, said lever pivotally mounted within said housing and said lever engaging said cam, said front panel pivotally moveable between a closed position securing said data terminal and an open position releasing said data terminal, wherein movement of said front panel is communicated by movement of said cam against said lever.

* * * * *